US010329129B2

(12) United States Patent
Rodenburg

(10) Patent No.: US 10,329,129 B2
(45) Date of Patent: Jun. 25, 2019

(54) SIDE PICKER LIFT APPARATUS

(71) Applicant: Gary Rodenburg, Rockford, MI (US)

(72) Inventor: Gary Rodenburg, Rockford, MI (US)

( * ) Notice: Subject to any disclaimer, the term of this patent is extended or adjusted under 35 U.S.C. 154(b) by 0 days.

(21) Appl. No.: 15/713,984

(22) Filed: Sep. 25, 2017

(65) Prior Publication Data

US 2018/0111809 A1 Apr. 26, 2018

Related U.S. Application Data

(60) Provisional application No. 62/411,816, filed on Oct. 24, 2016.

(51) Int. Cl.

| | |
|---|---|
| ***B66F 9/07*** | (2006.01) |
| ***B66F 9/075*** | (2006.01) |
| ***B66F 9/18*** | (2006.01) |
| *B66F 9/20* | (2006.01) |

(52) U.S. Cl.

CPC ..... *B66F 9/07* (2013.01); *B66F 9/0759* (2013.01); *B66F 9/18* (2013.01); *B66F 9/20* (2013.01)

(58) Field of Classification Search

CPC ..... B66F 9/07; B66F 9/0759; B66F 9/18; B66F 9/20; B66F 9/127

USPC ..... 414/592, 683

See application file for complete search history.

(56) References Cited

U.S. PATENT DOCUMENTS

| | | | | |
|---|---|---|---|---|
| 4,078,634 | A * | 3/1978 | Thomas | B66F 9/07 187/372 |
| 5,044,472 | A * | 9/1991 | Dammeyer | B66F 9/07545 180/273 |
| 5,096,018 | A * | 3/1992 | Dickinson, Jr. | B66F 9/127 182/222 |
| 5,383,758 | A * | 1/1995 | Patrick | B66F 9/061 414/10 |
| 7,347,299 | B2 * | 3/2008 | Billger | B60N 2/002 180/326 |
| 2013/0183127 | A1 * | 7/2013 | Dammeyer | B66F 9/075 414/592 |
| 2018/0111809 | A1 * | 4/2018 | Rodenburg | B66F 9/18 |
| 2018/0141796 | A1 * | 5/2018 | Kraimer | B66F 9/07 |

OTHER PUBLICATIONS

PMH, FIORA Fork lift truck manufacturer, Sep. 2009,4 pages, PK Series, published US; 4 pages.

* cited by examiner

*Primary Examiner* — Kaitlin S Joerger
(74) *Attorney, Agent, or Firm* — Price Heneveld LLP

(57) ABSTRACT

A side picker apparatus comprises a wheeled lift truck with powered lift tower configured to lift an operator platform and controls along with a carrier/storage unit for transporting picked elongated product. The storage unit is L-shaped and includes a chute section that guides picked product to an under-platform storage section located below/under the platform in a well-balanced storage position. The apparatus can be installed as a retrofit onto a modified order picker truck. The method includes picking elongated product and lowering/guiding it to the under-platform storage section. The storage section can include pop-up wheels that, in a ground-engaging position, pop up to assist in moving the picked product off the carrier/storage unit.

12 Claims, 16 Drawing Sheets

SIDE PICKER LIFT APPARATUS

CROSS-REFERENCE TO RELATED APPLICATION

This application claims benefit under 35 USC section 119(e) of U.S. Provisional Application Ser. No. 62/411,816, filed Oct. 24, 2016, entitled SIDE PICKER LIFT APPARATUS, the entire contents of which are incorporated herein by reference.

BACKGROUND OF THE INVENTION

The present invention relates to lift trucks and the like constructed to select elongated product from storage shelves/racks, and more particularly relates to a lift device where a worker rides with a platform to pick elongated product (i.e. especially product which is too long to easily hold and/or carry, such as 20 foot steel pipe of 20-50 lbs.) from elevated storage shelves/racks, transporting the selected/picked product back to ground level.

A number of lift devices are known. Side loaders (see FIGS. 11-12) are configured to lift a storage unit to a height where elongated product can be picked and set on the storage unit, and afterwards lowering the storage unit to a ground level. However, as shown in FIGS. 11-12, the operator and controls remain at ground level. This results in a circumstance where a second worker must climb the shelves/racks to pick product and put it on the storage unit. It is arguably unsafe for a worker to climb around to different levels on the storage racks. It is quite unsafe for a single worker to try to control the lift and also climb around racks to pick product, since they would have to climb around on the side loader and on the shelves/racks.

Fork lifts (FIGS. 13-14) can also be used. However, they include forks that extend away from the operator, such that they require a wide aisle. Further, a second worker must climb the shelves/racks to pick product and put it on the storage unit, which is unsafe as noted above. Like side loaders, it is quite unsafe for a single worker to try to control both a fork lift and also pick product, since they have to climb around on the fork truck and on the shelves/racks. Even with "4 directional" fork trucks, where the fork truck is adapted to move fore-aft as well as laterally, a very wide aisle is required due to a length of the fork truck and horizontally-extending forks. A wide aisle leads to excessively large storage areas and widely-spaced-apart storage racks, which adds considerably to overhead costs and poor retrieval time efficiency.

Order pickers (FIGS. 15-17) are lifts where the operator and controls move with a platform. The operator rides the platform, and can turn 90 degrees to pick product, resting the picked product on the platform adjacent his position. However, this does not work for elongated product (especially product that is 20 feet or longer), since elongated product can't easily be rotated 90 degrees due to its length, nor can it be "tucked" between the operator's feet. Also, the elongated product cannot be safely stored at an outer edge of the platform, since this would result in an unsafe and unbalanced position potentially tending to cause the order picker to tip toward the shelves/racks from which product is being picked. Also, the picked elongated product is often somewhat heavy (e.g. 20-50 lbs or more), which elongated product is unstable on a (narrow) platform of a typical order picker. This potentially creates a fall hazard which can hurt people below and also damage picked product that falls to the ground in the process. Also, a combined weight of the elongated picked product quickly adds up to an unacceptably heavy load that is unbalanced (in both fore-aft and side-to-side directions) and hence it cannot be stored at outer edges of the truck's forks, especially when the fork truck is being operated in raising and lowering operations.

A lift apparatus is desired that is particularly adapted for picking from high shelves/racks (such as 8-20 feet high) selected elongated product (such as 10-20 feet long) having significant weight (such as 10-20 lbs. or often 40-50 lbs. or more). Also, a lift apparatus is desired that is particularly adapted to retrieve elongated product, safely store and carry it to the ground, as well as to facilitate restocking of elongated product onto storage shelves/racks.

SUMMARY OF THE PRESENT INVENTION

In one aspect of the present invention, a side picker apparatus for handling elongated product stored on storage racks comprises a wheeled lift truck with a powered lift tower with an operator stand-on platform and lift controls; and a picked-product storage unit including an under-platform storage section located generally below the platform, the storage section being configured to receive elongated picked product lowered to a storage position in a weight-balanced position that is at least partially under the platform.

In another aspect of the present invention, a side picker apparatus comprises a wheeled lift truck with motor, power supply, motor-driven drive for moving the lift truck along an aisle, and a powered lift tower configured to lift an operator platform and lift controls; and an elongated picked-product storage unit including an under-platform storage section located generally under the platform and that is accessible from above by an operator, the storage section being configured to receive and store the picked product in a weight-balanced position and including a chute-forming open side that opens horizontally away from the lift tower and including open ends that open laterally outwardly from the open side, the open side providing a path for picked product to enter the storage section, and the open ends providing a space for outwardly-extending ends of the picked product to extend beyond edges of the platform.

In another aspect of the present invention, a side picker apparatus comprises a wheeled lift truck with motor, power supply, motor-driven drive for moving the lift truck along an aisle, and a powered lift tower configured to lift an operator platform and lift controls; and an elongated picked-product storage unit including a chute section constructed to guide picked product toward an under-platform storage section located generally under the platform and being configured to receive and store the picked product in a weight-balanced position, the chute section and storage section defining an L-shape that extends above and below the platform.

In another aspect of the present invention, a method of handling elongated product stored on storage racks, comprising steps of providing a wheeled lift truck with a powered lift tower with an operator stand-on platform and lift controls; the truck including an elongated picked-product storage unit including an under-platform storage section located generally below the platform, the storage section being configured to receive picked product from a vertical direction that is dropped by an operator and store the picked product in a weight-balanced position that is at least partially under the platform; raising the stand-on platform and under-platform storage section from ground level to a raised position; picking selected elongated product from a storage rack; lowering the picked product vertically to a location below the storage section while still in the raised position;

lowering the stand-on platform and picked product to ground level; and removing the picked product from the storage section.

In another aspect of the present invention, a side picker apparatus comprises a wheeled lift truck with motor, power supply, motor-driven drive for moving the lift truck along an aisle, and a powered lift tower configured to lift an operator platform and lift controls; and an elongated picked-product storage unit including an under-platform storage section located generally under the platform and that is accessible from above by an operator, the storage section being configured to receive and store the picked product in a weight-balanced position.

In another aspect of the present invention, a side picker apparatus comprises a wheeled lift truck with motor, power supply, motor-driven drive for moving the lift truck along an aisle, and a powered lift tower configured to lift an operator platform and lift controls; and an elongated picked-product storage unit including a chute section constructed to guide picked product toward an under-platform storage section located generally under the platform, the storage section being configured to receive and store the picked product in a weight-balanced position.

In another aspect of the present invention, a side picker apparatus is constructed for attachment to a wheeled lift truck with motor, power supply, motor-driven drive for moving the lift truck along an aisle, and a powered lift tower configured to lift an operator platform and lift controls. The improvement comprises an elongated picked-product storage unit configured for retrofit attachment to the wheeled lift truck and including a chute section constructed to receive picked product and an under-platform storage section located generally under the platform for storing the picked product in a weight-balanced position.

In another aspect of the present invention, a side picker component shaped to both store elongated product and guide the elongated product to a storage area, comprises a product-guiding-and-storing component including a vertical-wall-simulating, chute-forming section constructed to guide picked product that is falling by gravity, and a horizontal-shelf-simulating under-platform storage section extending from the chute-forming section to define an L-shape, the component including attachments for supporting the component with the chute-forming section adjacent a platform and the storage section extending under the platform to thus store picked elongated product in a weight-balanced position under the platform.

In another aspect of the present invention, a method of picking and temporarily storing elongated picked product comprises providing a wheeled lift truck with motor, a power supply, a motor-driven drive for moving the lift truck along an aisle, and a powered lift tower configured to lift an operator platform and lift controls; providing a picked-product storage unit including a chute section and an under-platform storage section; dropping picked product into the chute section by gravity; and storing the picked and dropped product under the platform in the storage section in a weight-balanced position.

In another aspect of the present invention, a side picker apparatus comprises a wheeled lift truck with motor, power supply, motor-driven drive for moving the lift truck along an aisle, and a powered lift tower configured to lift an operator platform and lift controls; an under-platform storage section located generally under the platform and configured to receive and store the picked product in a weight-balanced position, the storage section including pop-up wheels that move vertically when the storage section is lowered to a ground-adjacent position, the wheels being configured to lift and support product for wheeled movement off an end of the storage section.

These and other aspects, objects, and features of the present invention will be understood and appreciated by those skilled in the art upon studying the following specification, claims, and appended drawings.

BRIEF DESCRIPTION OF DRAWINGS

Prior art

Prior art

Prior art

DETAILED DESCRIPTION OF PREFERRED EMBODIMENTS

Figure 1:
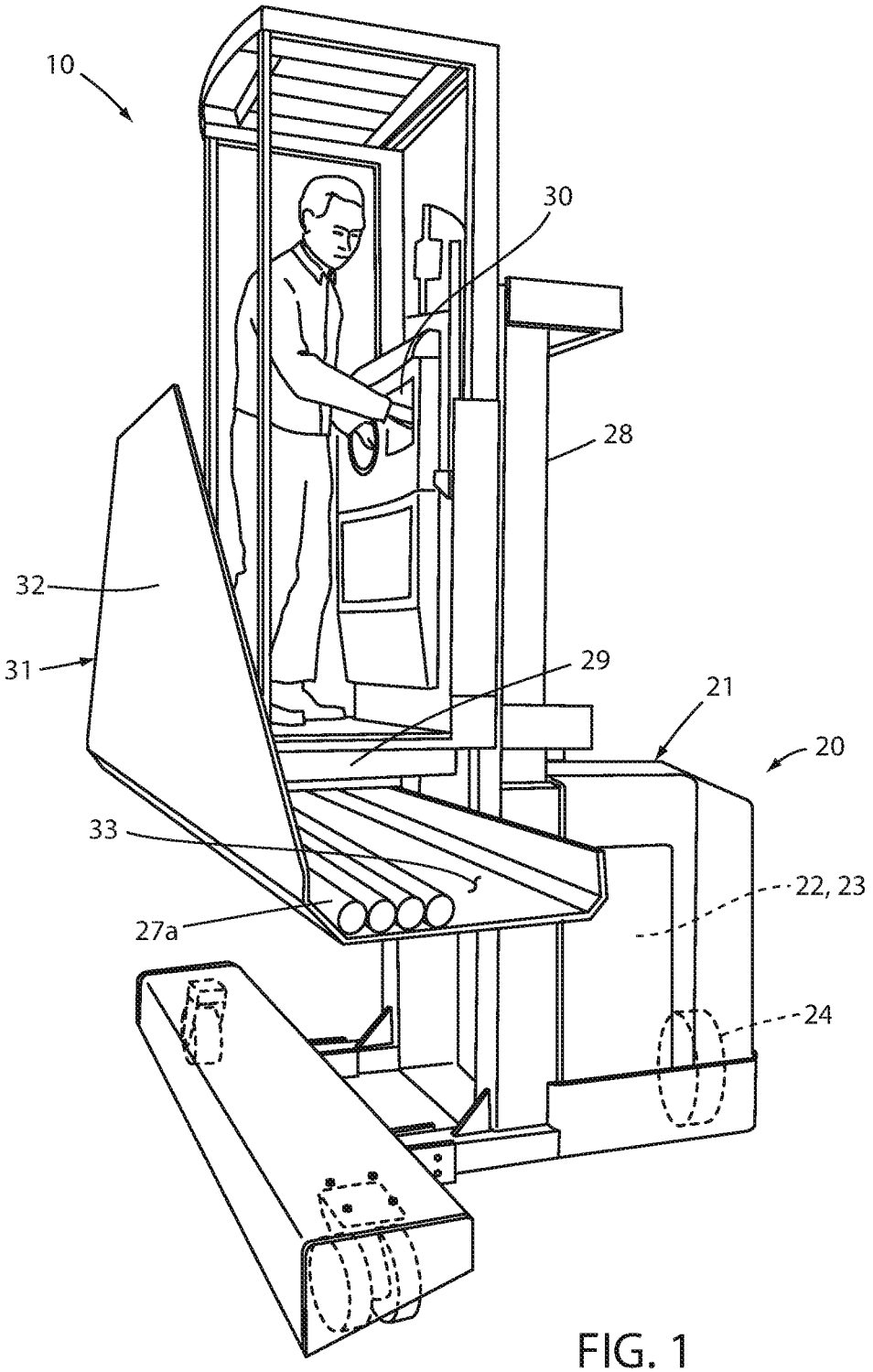
FIG. 1 is a perspective view of an innovative side picker apparatus configured to lift a worker while picking elongated product (such as 12 foot to 20 foot bar stock, tubes, and the like of significant weight) from a vertically-high storage rack, the side picker being configured to safely lift the worker and store picked product while maintaining a relatively-large balanced load and having an ability to work in narrow aisles.

The present apparatus 10 is a wheeled side picker particularly adapted to allow a single worker to pick elongated semi-heavy product (e.g. 12-20 feet long and weighing 20-40 lbs. or more). The illustrated apparatus 10 is attached to a side picker apparatus 20 comprising: a wheeled lift truck 21 with motor 22, power supply 23, motor-driven drive 24 for moving the lift truck along an aisle 25 between vertically-spaced storage racks 26 of long product 27, and a powered lift tower 28 configured to lift an operator platform 29 and lift controls 30. As discussed below and shown in FIG. 6, the drive wheel(s) of the lift truck 21 are modified by reorienting the drive wheels at 90 degrees to allow the modified lift truck 21 to move more easily directly along a front edge of a storage rack in a totally different manner than originally designed. (i.e., the modified apparatus 10 can move along a storage rack parallel a length of elongated product in a manner allowing the elongated product to be slid off the storage racks onto the present apparatus without significant manipulation/reorienting of the elongated product.) It is noted that this change is considered significant, surprising, and unexpected, since it allows a much more efficient process of use that is far more consistent with the intended use of the present innovation, yet it also provides a major cost savings in capital investment by allowing the fork truck to be purchased from an existing mass manufacturer and modified as noted herein. The illustrated present apparatus 20 can be installed as a bolt-on accessory to the structure of the illustrated fork truck, again saving considerable capital investment for the user. However, it is contemplated that novel original equipment can also be constructed from the present disclosure.

The apparatus 10 includes an elongated-picked-product storage unit/component 31 that is L-shaped, with sections extending adjacent and under the platform 29. The L-shaped component 31 includes a chute section 32 constructed to receive picked product 27*a*, the picked product 27*a* being dropped and directed by chute section 32 to an under-platform storage section 33 located generally under the platform 29. The storage section 33 is configured to vertically receive and then store the picked product 27*a* in a weight-balanced position on the storage unit/component 31 under the platform 29 (relatively close to the lift truck 21), with opposing ends of the picked product 27*a* extending outwardly from open ends of the storage section 33. The storage section 33 (and picked product 27*a*) can then be moved to a position adjacent the ground/floor when the platform 29 is lowered to a lowermost ground-adjacent position. The apparatus 20 can include spring-supported wheels or rollers 35 (FIG. 5, but also see FIG. 28-30) so that, as the storage section 33 contacts the ground floor, the rollers 35 are biased to a position where they extend slightly above an upper surface of the storage section 33, thus lifting the picked product 27*a* and supporting the picked product 27*a* as it is rolled on the rollers 35 off the storage section 33 onto a work surface.

Figure 5:
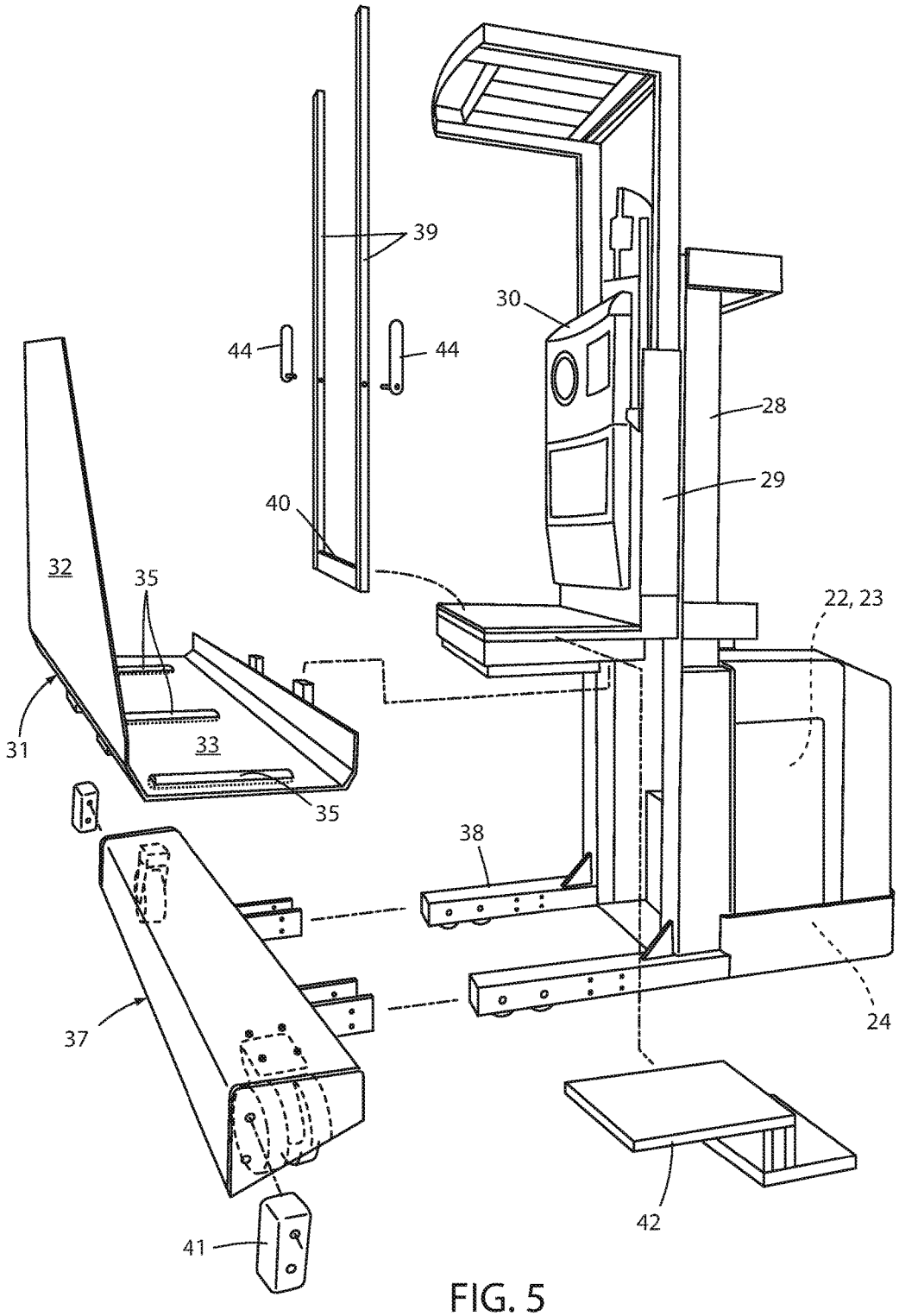
FIG. 5 is an exploded view of the side picker apparatus of FIG. 1.

FIG. 5 shows an exploded view of various components of the apparatus 10. The caster-supporting stationary carrier 37 is configured for retrofit bolted attachment to the lateral wheeled legs 38 of the lift truck 21. The illustrate lift truck 21 was constructed from an existing side picker lift device, but with drive wheels (not specifically shown in FIG. 5 but see FIG. 1) re-oriented 90 degrees so lift apparatus 10 moves in a totally different sideways direction than it was originally designed for. Also shown are a safety fence comprising posts 39 and toe guard 40 (i.e. kick guard) attached to the platform 29 for operator safety. A rubber bumper 41 is added to an end of a stationary caster-supporting housing/carrier 37 to cushion impacts against a hard object (such as a rack's base or other rigid structure often encountered by the apparatus 10). Steps 42 can be attached to the platform 29 to help with access to and egress from the platform 29.

Figure 2:
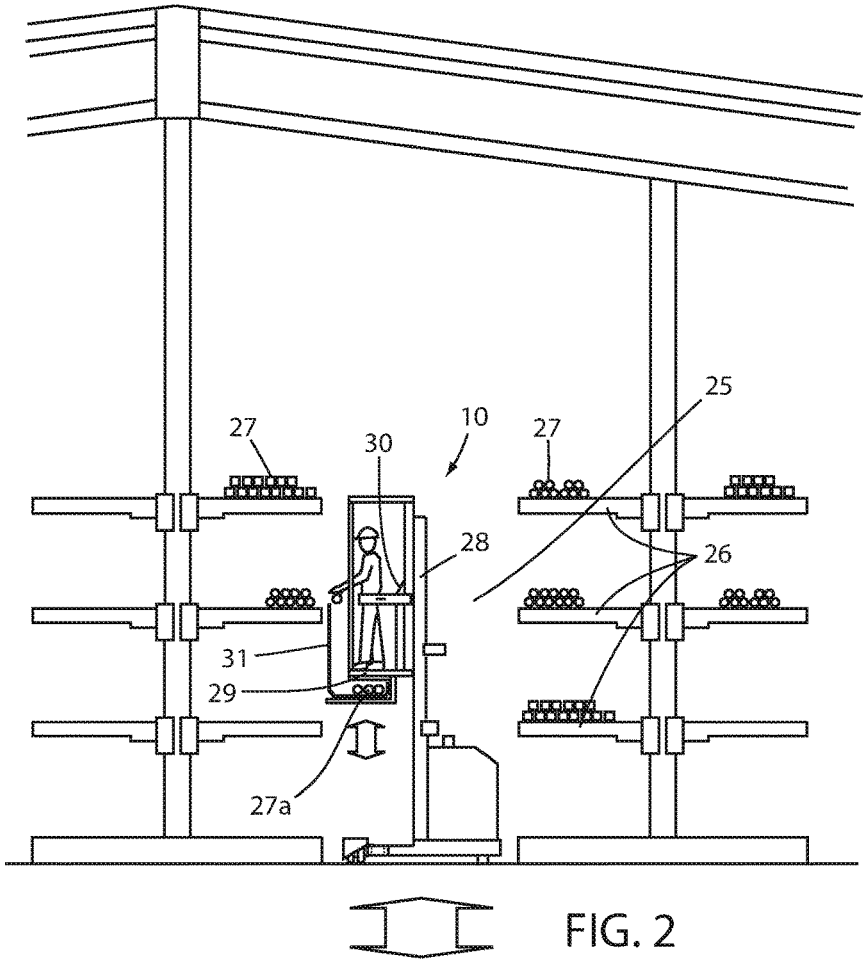
FIGS. 2-3 are side and rear views of the side picker apparatus and worker from FIG. 1 adjacent bar storage racks where elongated product is being picked.
Figure 2A:
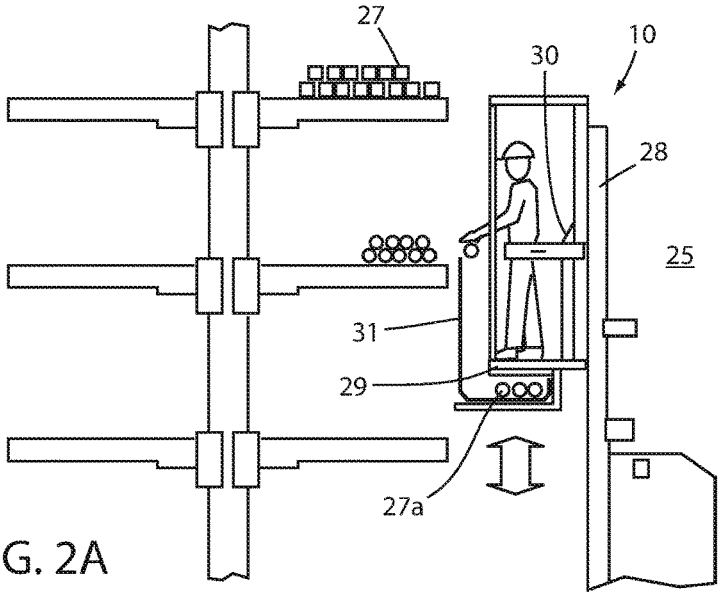
FIG. 2A is an enlarged view from FIG. 2 of the operator-platform and L-shaped storage unit (also called a picked-product carrier) showing the under-platform storage section and chute section.
Figure 3:
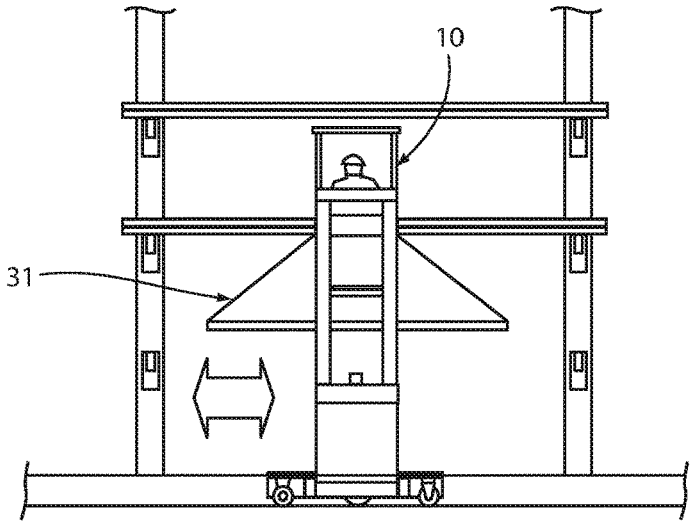
Figure 4:
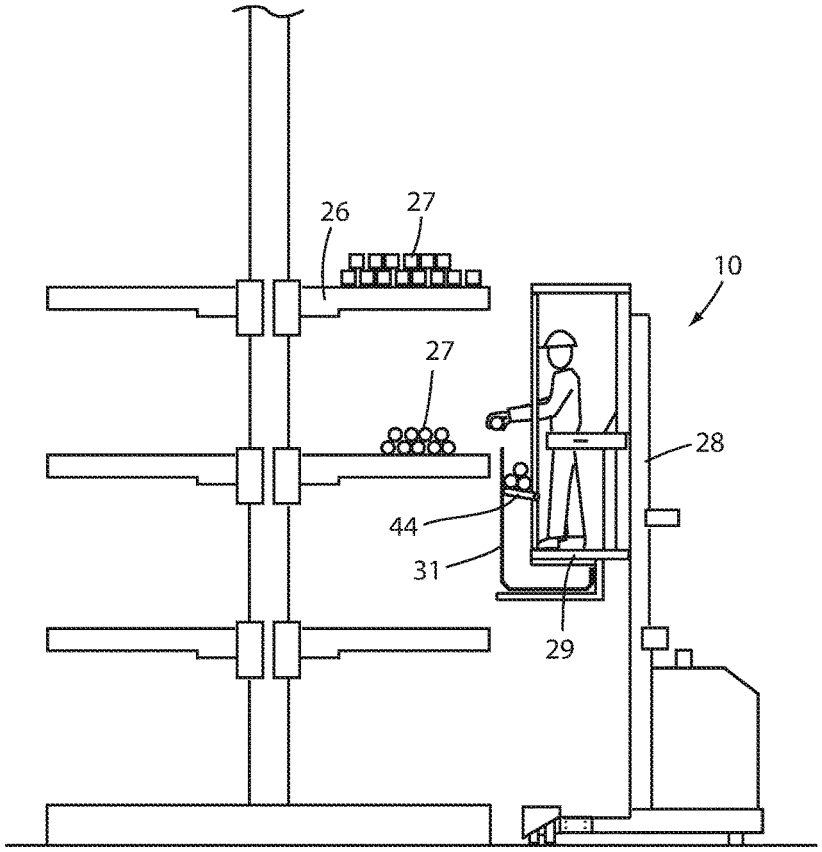
FIG. 4 is a view similar to FIG. 2 but showing product being restocked by taking "new" product lifted/carried by the present storage unit and restocking/placing it onto storage shelves.
Figure 6:
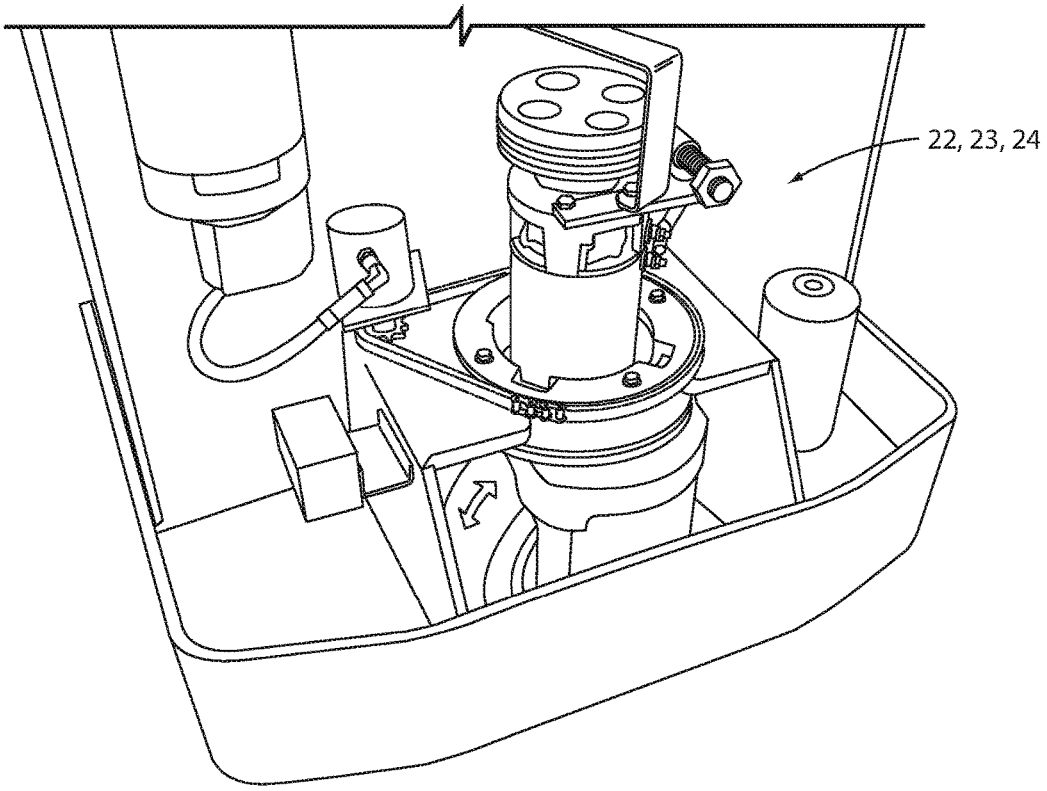
FIG. 6 is a picture of a wheel drive mechanism positioned to fit on the side picker apparatus of FIG. 1.
Figure 7:
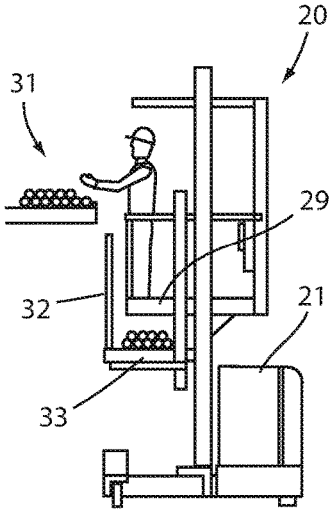
FIGS. 7-8 and also
Figure 8:
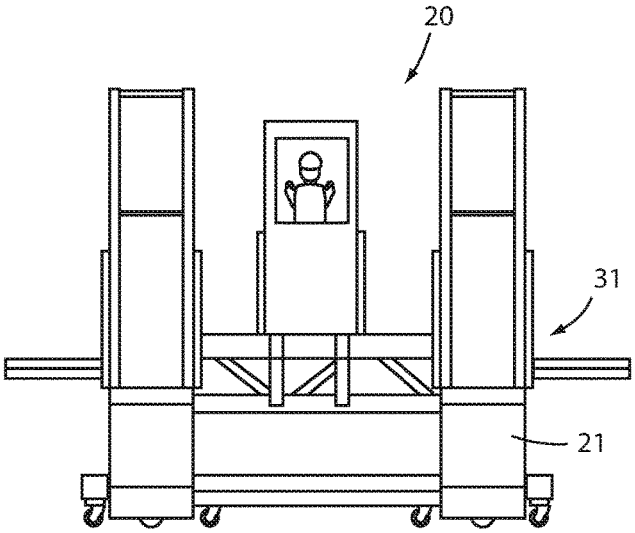
Figure 9:
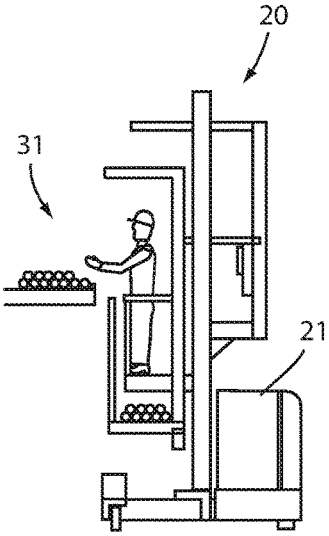
FIGS. 9-10 are side and rear views, respectively, of modified embodiments of the present innovative side picker apparatus in FIG. 1, each showing a side picker apparatus with spaced-apart lift towers and a centrally located worker cabin.
Figure 10:
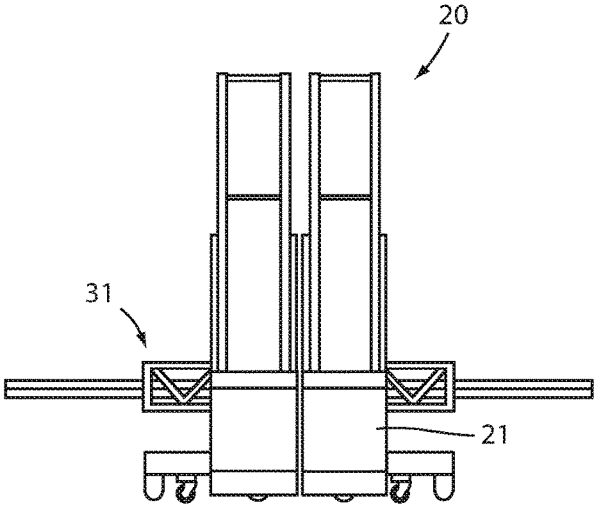
Figure 11:
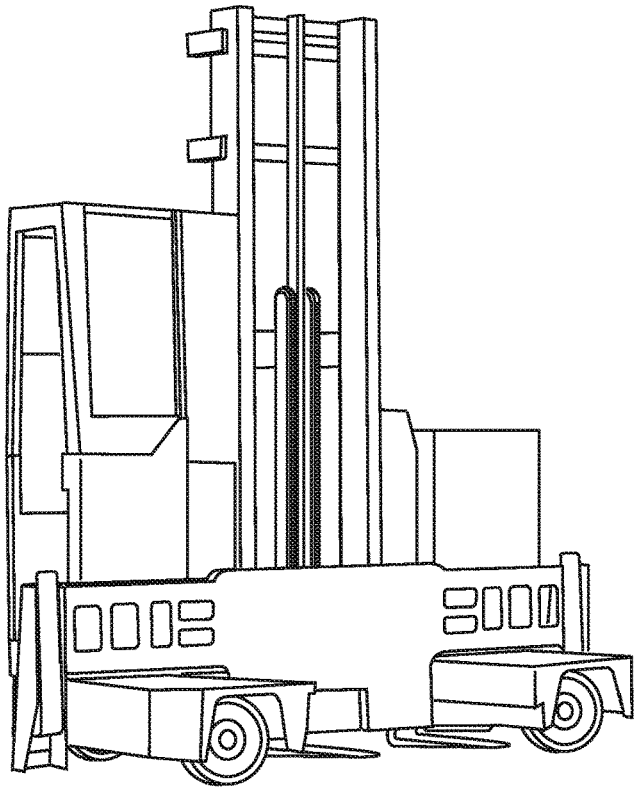
FIG. 11 Prior Art
FIGS. 11-12 are perspective views of a side loader in prior art, the side loader being used to pick elongated product from racks.
Figure 12:
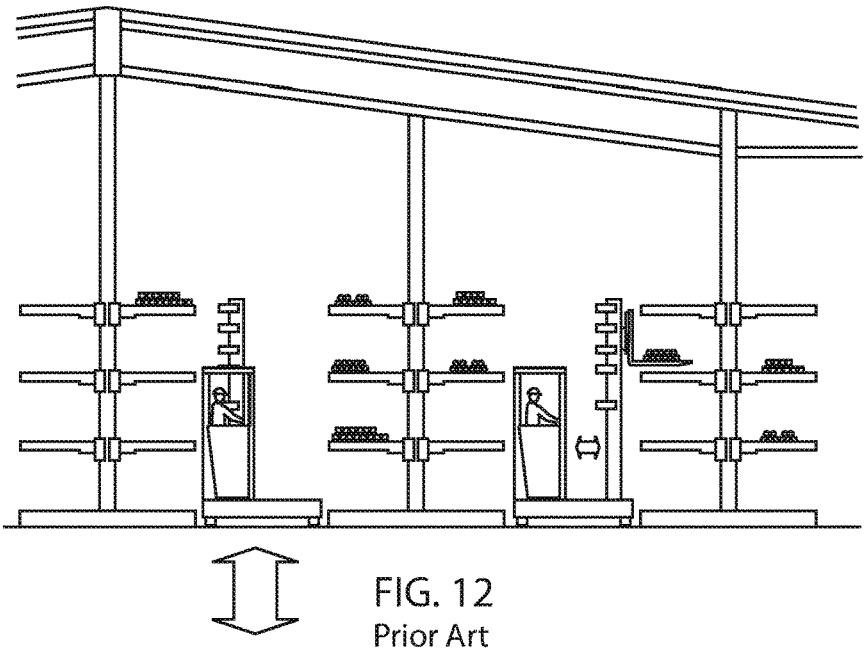
FIG. 12 Prior Art
Figure 13:
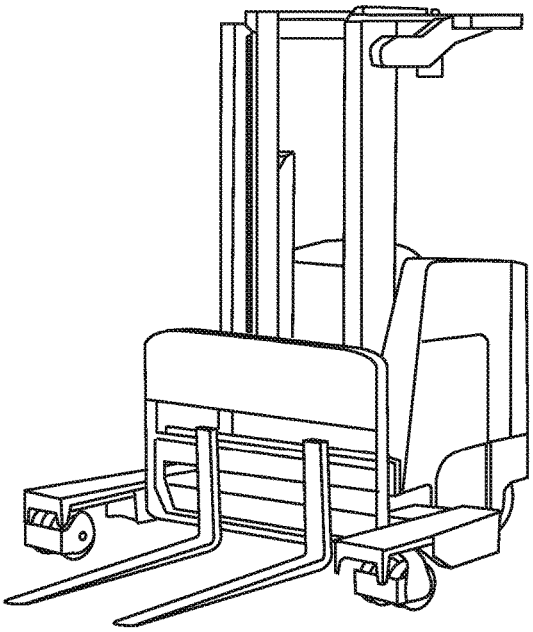
FIG. 13 Prior Art
FIGS. 13-14 are perspective views of a fork truck in prior art, the fork truck being used to pick product from racks.
Figure 14:
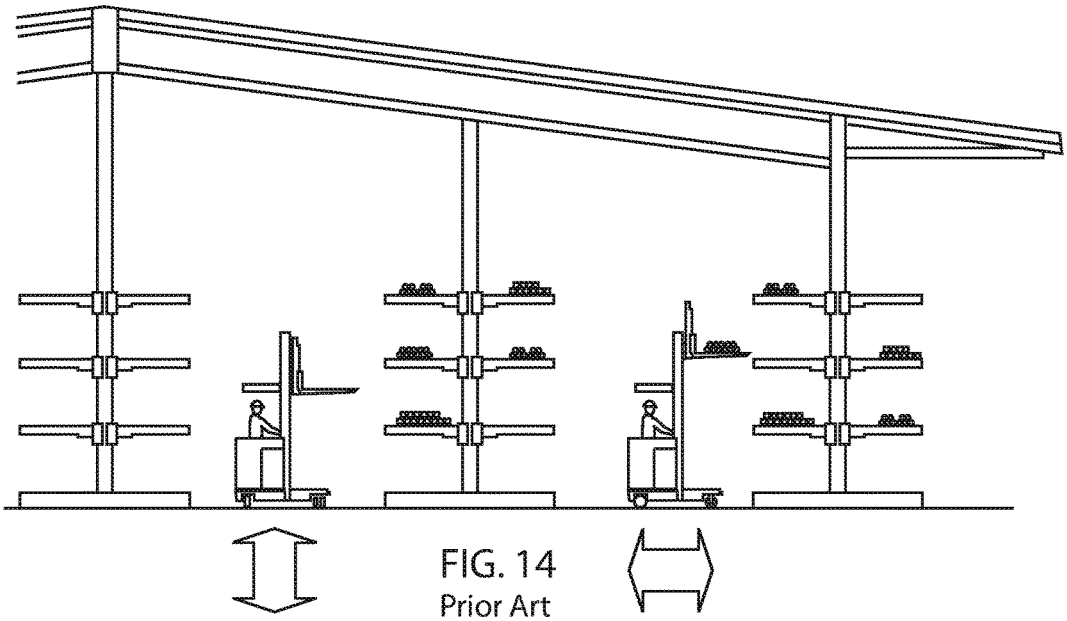
FIG. 14 Prior Art
Figure 15:
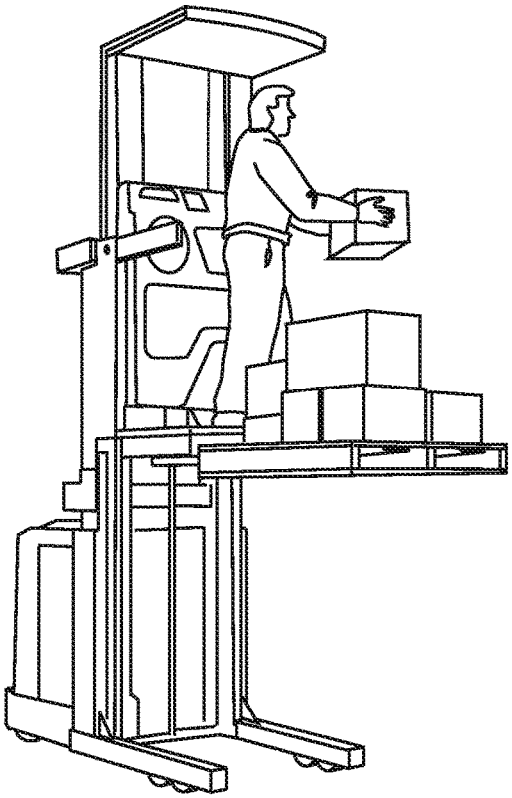
FIG. 15 Prior Art
FIGS. 15-17 are perspective views of an order picker in prior art, the order picker being used to pick short product from racks.
Figure 16:
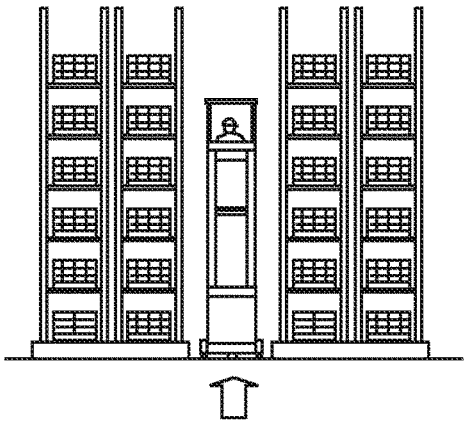
FIG. 16 Prior Art
Figure 17:
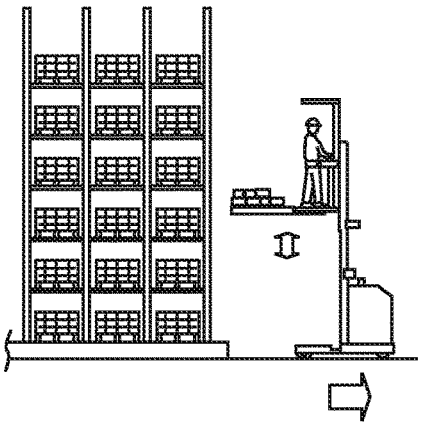
FIG. 17 Prior Art

The present innovative side picker apparatus (FIG. 1) is configured to lift a (single) worker while picking elongated product (such as 12 foot to 20 foot bar stock, tubes, and the like of significant weight) from a vertically-high storage rack, the side picker being configured to safely lift the worker and store picked product while maintaining a relatively-large balanced load and having an ability to work in narrow aisles. The present apparatus allows a single worker to pick efficiently and quickly and safely, yet while working alone. FIGS. 2-3 are side and rear views of the side picker apparatus and worker from FIG. 1 adjacent bar storage racks where elongated product is being picked. FIG. 2A is an enlarged view from FIG. 2 of the operator-platform and L-shaped storage unit (also called a picked-product carrier) showing the under-platform storage section and chute section. FIG. 4 is a view similar to FIG. 2 but showing product being restocked by taking "new" product lifted/carried by the present storage unit and restocking/placing it onto storage shelves. FIG. 5 is an exploded view of the side picker apparatus of FIG. 1. FIG. 6 is a picture of a wheel drive mechanism rotated 90 degrees and reattached/positioned to fit on the side picker apparatus of FIG. 1 to provide a "new" direction of primary movement. FIGS. 8-9 and also FIGS.

9-10 are side and rear views, respectively, of modified embodiments of the present innovative side picker apparatus in FIG. 1, each showing a side picker apparatus with spaced-apart lift towers and a centrally located worker cabin.

FIGS. 11-17 show prior art that was previously discussed.

Modification

A modified material handling apparatus 120 is shown in FIGS. 18-30, and like apparatus 10 and 20 is adapted for movement in and along storage racks 26 where elongated product 27 is stored. The apparatus 120 is very similar to the above-described structure, using much identical structure and similar components, as will be recognized by persons skilled in this art. Specifically, the material handling apparatus 120 includes a modified side picker apparatus 20 with similar and identical components (21-24, 28-33, see FIGS. 1, 5) for handling picked elongated product (27*a*). The apparatus 120 further includes a powered lift tower/lifting/lowering mechanism 121 with guided picking-hand brackets 141 that facilitate picking and restocking of elongated product 27.

The apparatus 120 (FIG. 18) includes a frame 130 supporting the storage unit on the base structure of the lift truck 21, the frame 130 including a horizontal/top load beam 131 and vertical load beam supports 132 fixed/attached to the load beam 131 (and movable along with the platform 29 and controls 30). A drive shaft 133 is operably mounted above the load beam 131, and a slave shaft 134 is mounted below the platform 29. Right and left (top) sprockets 137 are mounted on the ends of drive shaft 133, and right and left (bottom) sprockets 138 are mounted on the ends of slave shaft 134. A chain 135 extends around the right sprockets 137 and 138 and a second chain 135 extends around the left sprockets 137 and 138. Vertical guides 136 extend between the shafts 133 and 134 for guiding the chain 135 and the brackets 141 between the sprockets 137 and 138. A bottom dump and sweep wrist carrier bracket 140 carries a first (bottom) L-shaped picking-hand bracket 141, and an upper carrier bracket 142 carries one or more restocking-hand L-shaped brackets 141 (four being illustrated). The illustrated brackets 141 are L-shaped. The brackets 141, when in a "normal" carrying position have a shorter horizontal bottom flange that extends to a position close to the vertical panel forming the chute section 32 (see FIGS. 22 and 22A), and a longer section that travels parallel the vertical panel of the chute section 32 (see FIG. 22A). This orientations continues during vertical movement of the bracket 141 until the bracket 141 hits bottom and begins to pass around a bottom pivot and kicks the picked product onto the storage section 33 (see FIGS. 25-27). A bottom surface of the bottom (first) L-shaped bracket 141 (FIGS. 22, 22A) includes a semi-circular recess 141*a* (FIG. 22) that engages a bearing on an end of the shaft 134 to facilitate rotation of the bottom bracket 141 at a bottom of its vertical travel. This pivoting movement facilitates "dumping" the picked elongated product onto the storage section 33 as shown in FIGS. 22-27, as described below.

The powered lift/lowering mechanism 144 (FIG. 20) includes a drive mechanism for moving the picking-hand brackets 141 vertically downwardly at a slow enough speed to prevent damage to picked product. The drive mechanism is shown as a cylinder 145 with extendable shaft 145*a* connected to a chain 146 that extends around a sprocket 147 on the drive shaft 133. A size of the sprocket 147 is smaller than sprocket 137 so that a travel/distance of the picking-hand brackets 141 can be long enough to be sufficient for their intended purpose. (i.e., the present arrangement causes the brackets 141 to travel farther than the extendable shaft 145*a*, thus allowing sufficient room for the illustrated powering mechanism while still providing a desired long range of motion of the brackets 141.) It is contemplated that a variety of different drive mechanisms could be used instead of a hydraulic cylinder, such as electric and/or other motivating devices. It is also contemplated that different devices other than the one illustrated can be used to slow the downward movement of picked elongated product as each one is dropped into the chute section and falls to the storage section, including different powered and non-powered (e.g. mechanical dampener and friction-type) mechanisms. The illustrated drive mechanism 145/145*a* forcibly moves the bottom bracket 141 against the shaft 134, causing it to move around an arc at a bottom of its vertical travel (see FIGS. 22-27), causing it to "kick" (i.e. provide an addition push) the dumped picked product into the storage section 33. An outer edge of the bottom bracket 141 can include a flexible edge or spring-biased finger 141*b* (FIGS. 26-27) that further assists in "kicking" the picked elongated product 27*a* into the storage section 33 while avoiding any interference during its movement. For example, the finger 141*b* can be pivoted to assist in allowing return of the bottom bracket 141 around the shaft 134 toward its vertical travel along the guide 136 without interference from the storage section 33. Knobs or bumps can be placed on the storage section 33 (FIG. 27) to prevent the picked elongated product 27*a* in the storage section 33 from rolling back to a position that interferes with operation of the picking-hand bracket 141. It is contemplated that other gates or swinging anti-return devices could be used to retain the picked product in the storage section 33. It is contemplated that a size and shape and clearances between the brackets 141 and other components can be varied to facilitate handling of specific product, and other equipment needs and desires.

The storage section 33 (FIGS. 28-30) includes a horizontal panel with slots 150. Cylinder rollers 151 are operably mounted in the slots 150 so that they do not protrude above the horizontal panel of lower beam 152 of apparatus 10 (FIG. 28) during the product-picking operation (FIG. 29). When in the ground-engaging position (FIG. 30), the ground presses the rollers 151 upward so they protrude into the storage section 33, slightly raising the elongated picked product 27*a* (FIG. 30) above the storage section 33. This allows the picked product 27*a* to be rolled outwardly longitudinally, which greatly facilitates the ease and efficiency of removing the picked product 27*a* from the storage section 33.

It is contemplated that the present terms will be broadly understood. For example, a lowering device is intended to include any lowering device that facilitates efficient and non-damaging lowering of a product, including powered and non-powered mechanisms. Also for example, picked product can be biased into the storage section in a number of different ways, including a specific mechanism to "kick" it laterally toward a middle of the storage section, and including other devices such as flexible fingers (see fingers 148, FIG. 27) that keep deposited picked product on the storage section 33 once it is placed there. The anti-rollback "fingers" could be resilient material, or spring-biased levers, or gravity-biased anti-return devices, or the like.

Figure 18:
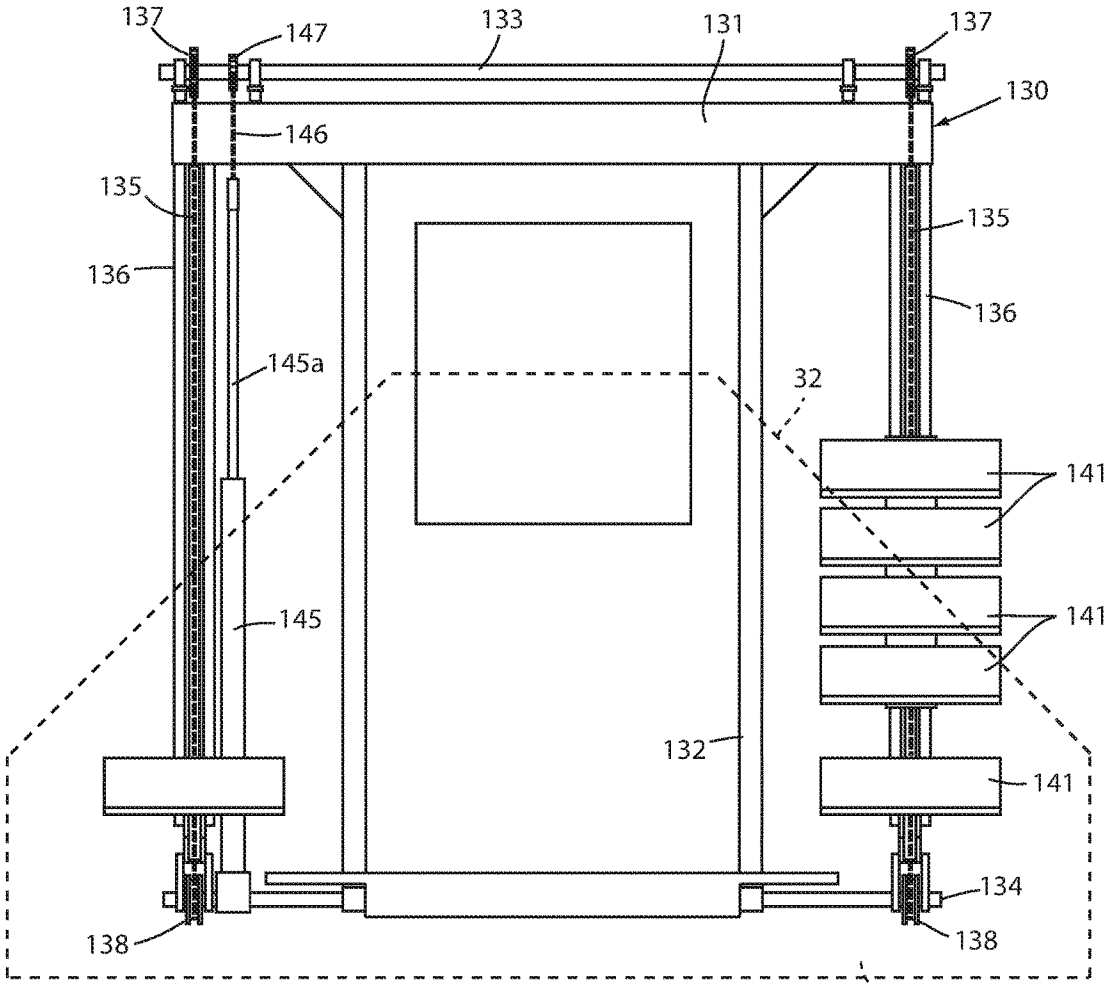
FIGS. 18-18A are front and side views of another modified version of the present innovative order picker apparatus, the L-shaped picked-product carrier (including a chute section and storage section), the carrier being shown in dashed lines in FIG. 18 and removed in FIG. 18A to better show underlying and adjacent components, including the power lift/lower mechanism with chain guide and picking-hand brackets.
Figure 18A:
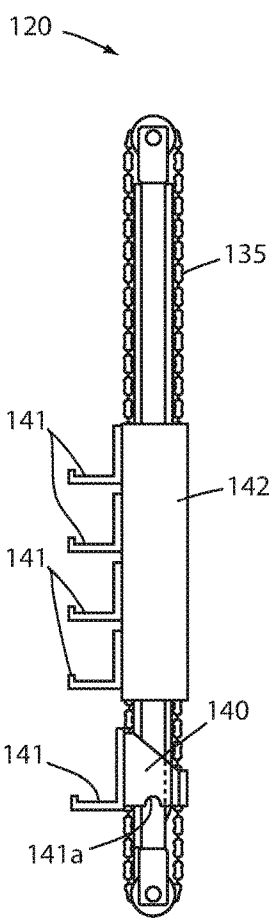
Figure 19:
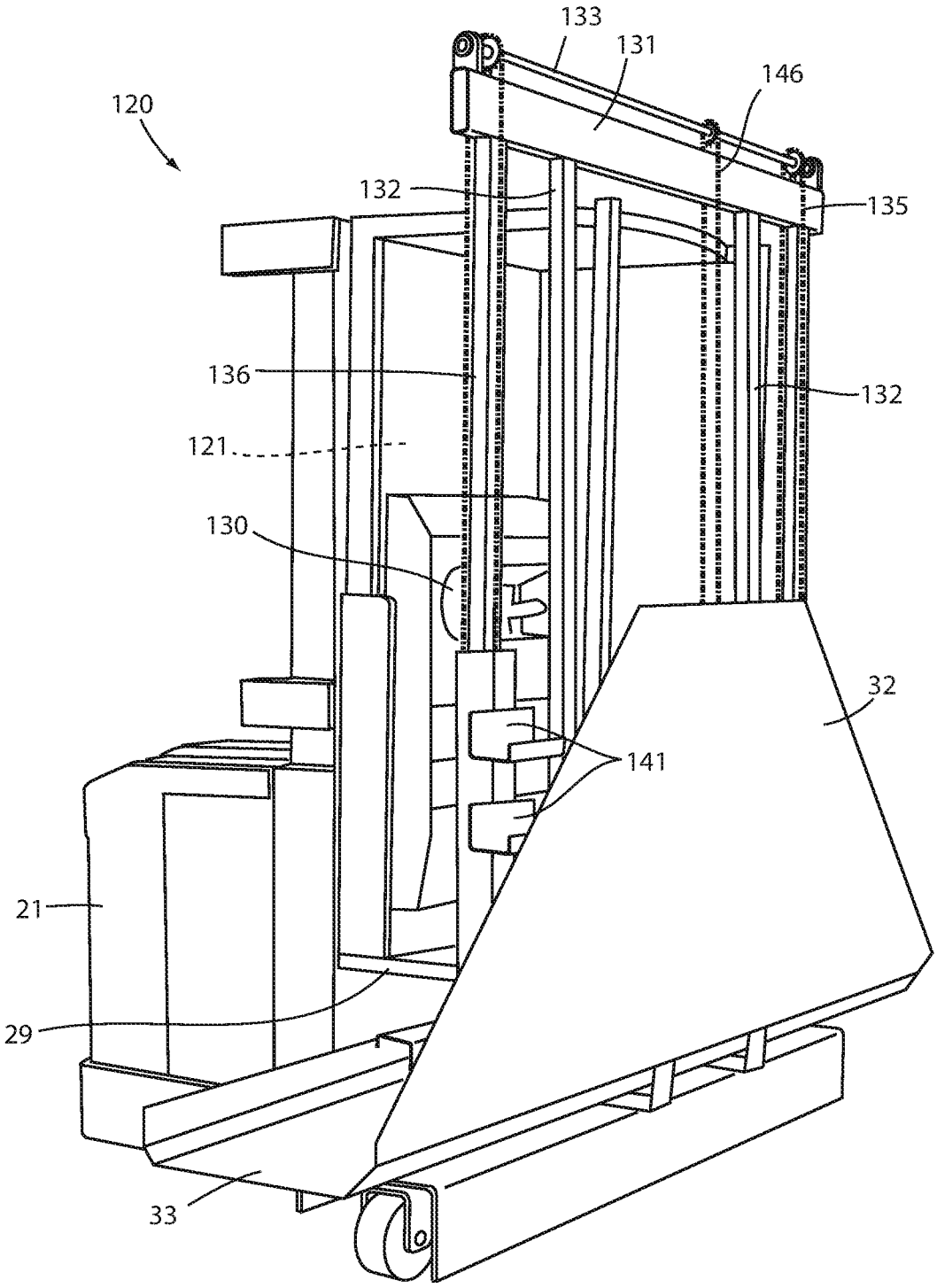
FIGS. 19-20 are perspective views of the apparatus of FIG. 18, with FIG. 20 being identical to FIG. 19 but with the vertical chute section being shown in dashed lines to better show underlying components.
Figure 20:
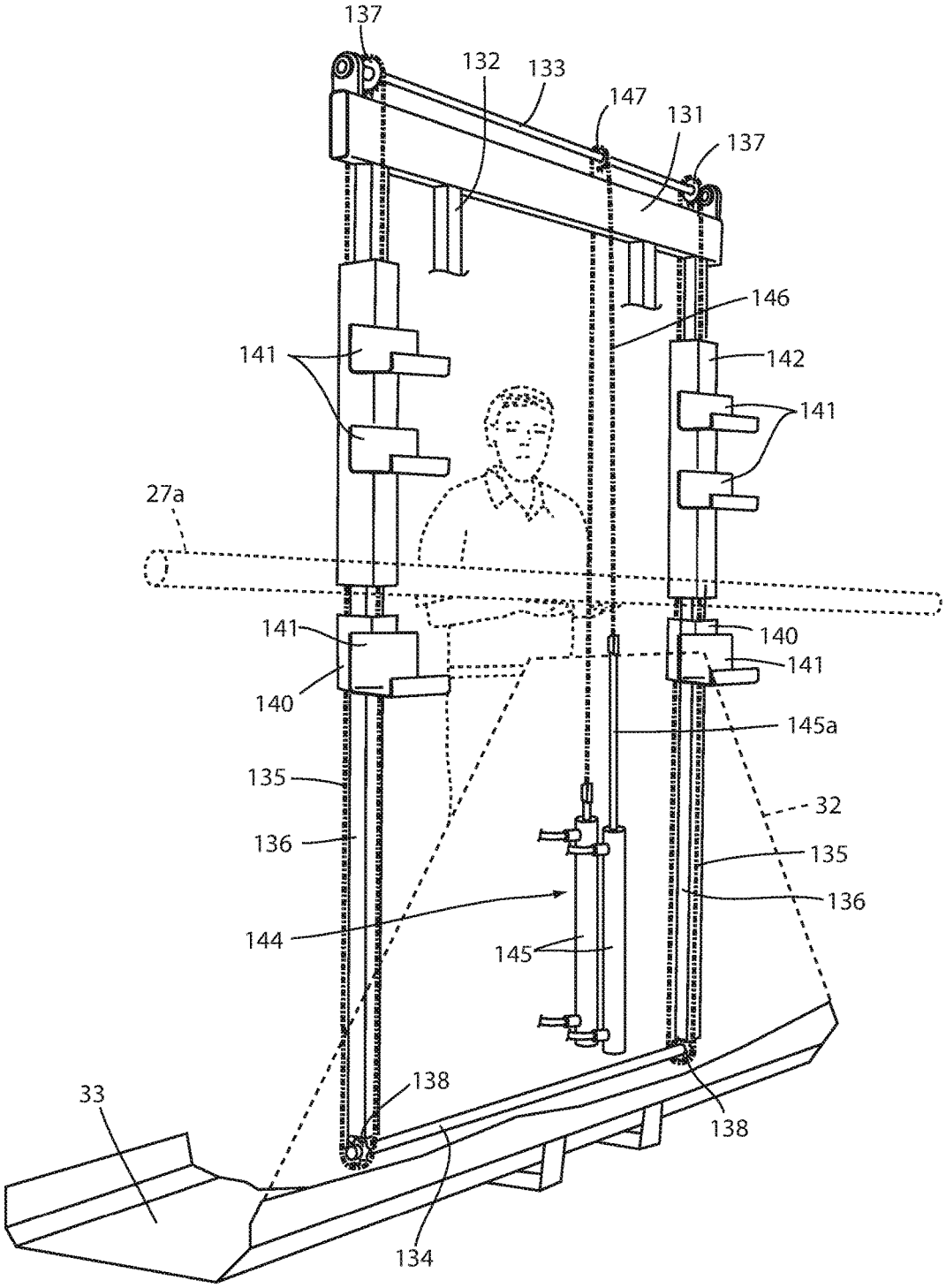
Figure 21:
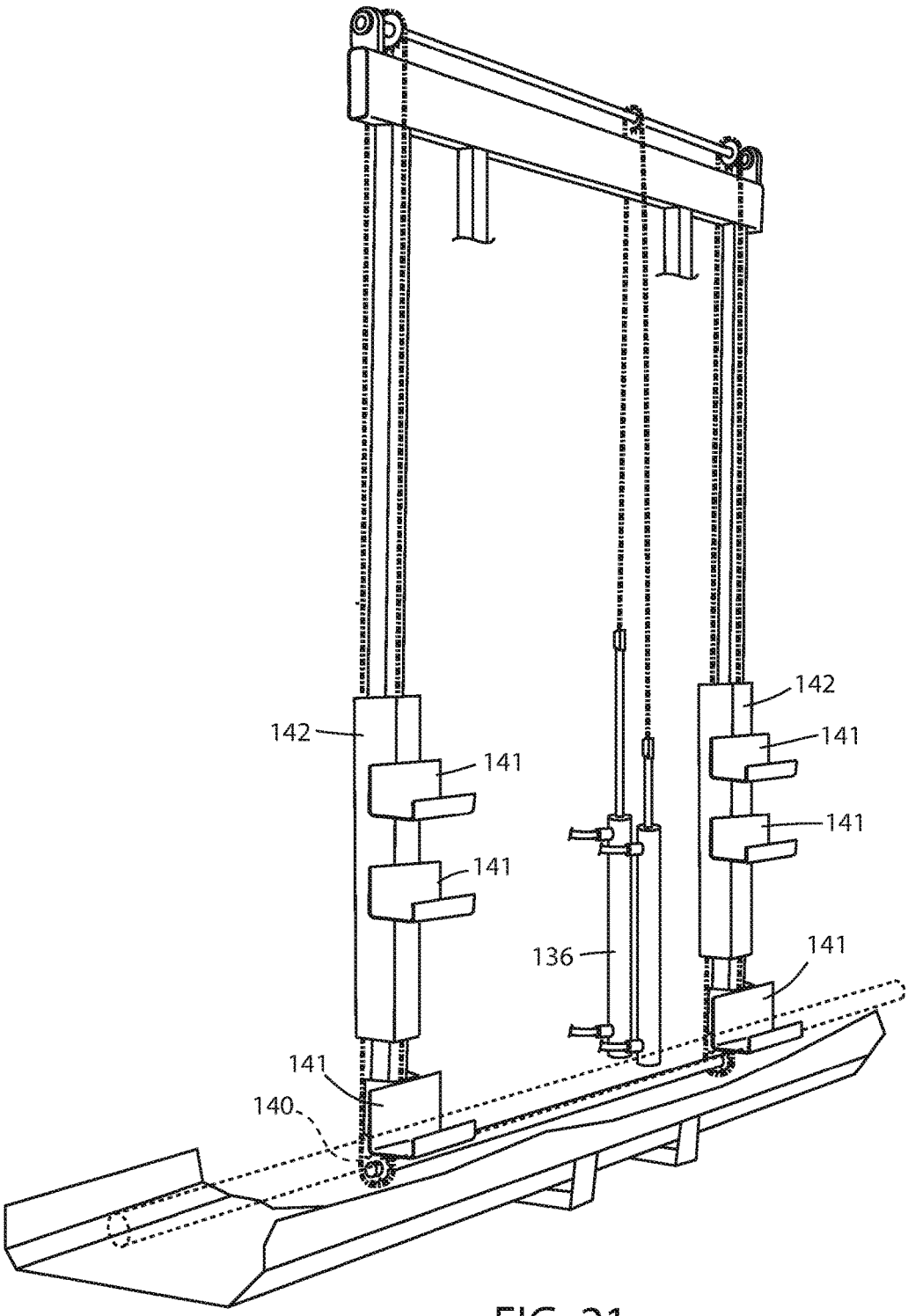
FIG. 21 is a partial perspective view showing the power lift mechanism with a horizontally aligned pair of bottom picking-hand brackets capable of carrying a picked product to a position slightly above bottom (i.e. before the picking-hand bracket engages the bottom bearing for rotation), and showing additional picking-hand brackets above the bottom pair.
Figure 22:
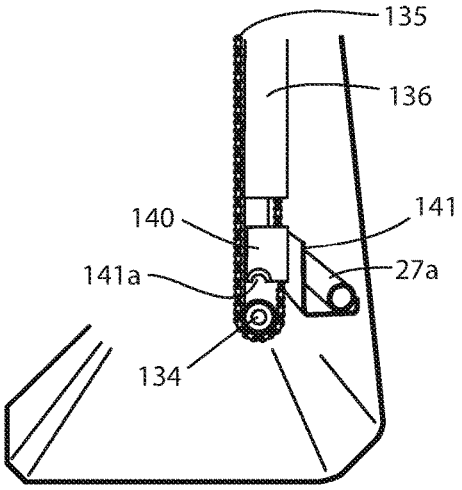
FIG. 22 is a side view of FIG. 21 showing the power lift mechanism including the picking-hand bracket as the power lift mechanism lowers a picked product.
Figure 22A:
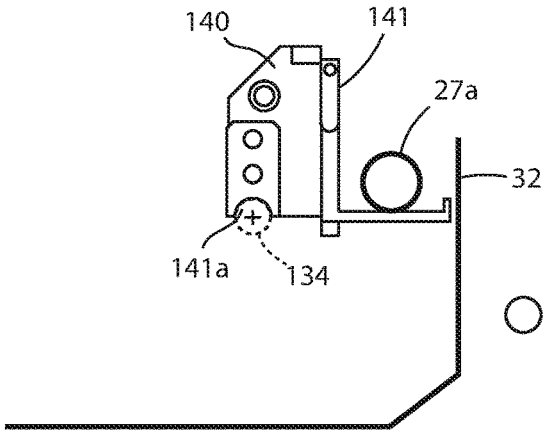
FIG. 22A shows the bottom picking-hand bracket engaging the rotation-causing bearing.
Figure 23:
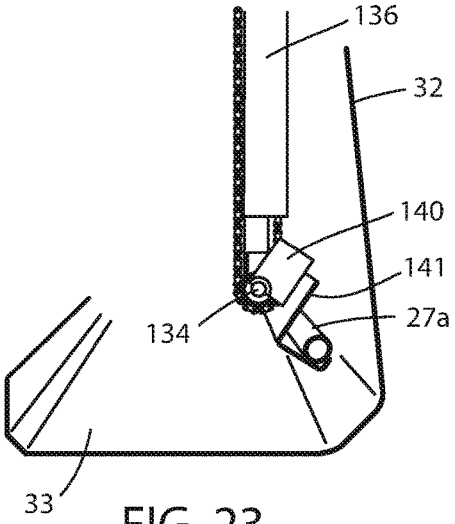
FIG. 23 is a side view like FIG. 22 but showing continued downward movement of the picking-hand bracket from FIG. 22, including the picking-hand bracket engaging the bottom bearing and beginning rotation around the bottom bearing.
Figure 24:
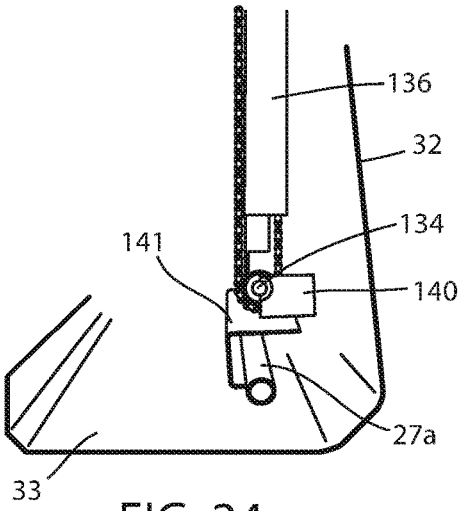
FIGS. 24-25 are views similar to FIG. 23 but showing additional rotation of the picking-hand bracket and showing depositing of the picked product into the storage section as the power lift mechanism continues to move to a lowermost position.
Figure 24A:
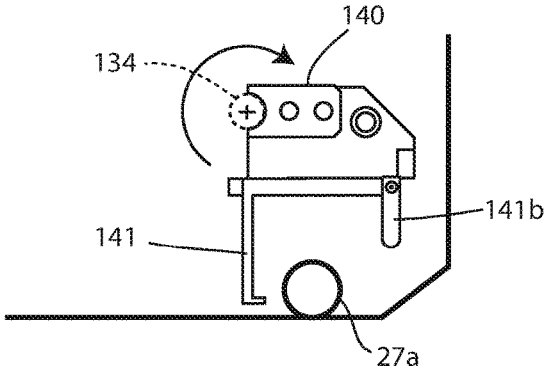
FIG. 24A is a view like FIG. 24 but with the chain drive and bottom bearing removed to better show other components.
Figure 25:
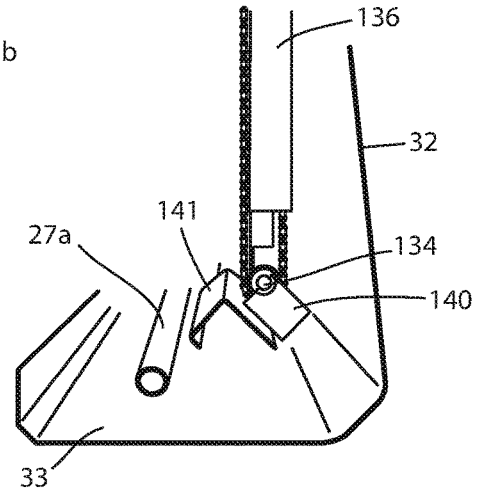
Figure 26:
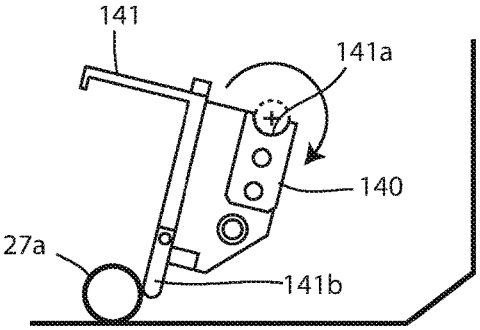
FIGS. 26 and 27 are views showing the picking-hand bracket, FIG. 26 showing the bracket giving the deposited picked product a last "push" and FIG. 27 showing initial "reverse" movement of the picking-hand bracket as the power lift mechanism moves toward a lifting phase where the picking-hand bracket will again move vertically.
Figure 27:
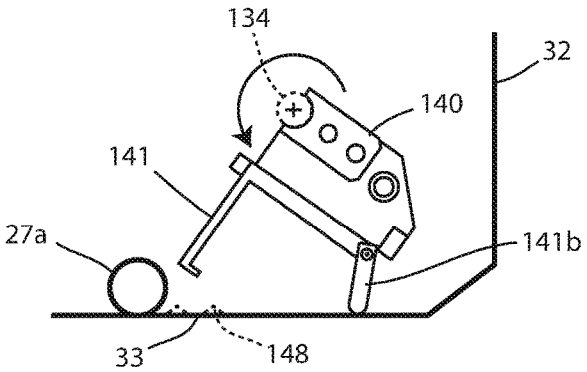

FIGS. 19-20 are perspective views of the apparatus of FIG. 18, with FIG. 20 being identical to FIG. 19 but with the storage unit (i.e., vertical chute section and under-platform storage section) shown in dashed lines to better show underlying components. FIG. 21 is a partial perspective view showing the power lift mechanism with picking-hand brackets carrying a picked product and lowered to a position slightly above bottom (i.e. before the picking-hand bracket engages the bottom bearing for rotation). FIG. 22 is a side view of FIG. 21 showing the power lift mechanism including the picking-hand bracket as the power lift mechanism lowers a picked product. FIG. 23 is a side view like FIG. 22 but showing continued downward movement of the picking-hand bracket from FIG. 22, including the picking-hand bracket engaging the bottom bearing and beginning rotation around the bottom bearing. FIGS. 24-25 are views similar to FIG. 23 but showing additional rotation of the picking-hand bracket and showing depositing of the picked product into the storage section as the power lift mechanism continues to move to a lowermost position. FIGS. 22A and 24A are views like FIGS. 22 and 24 respectively, but with the chain drive and bottom bearing removed to better show other components. FIGS. 26 and 27 are views showing the picking-hand bracket giving the deposited picked product a last "push" (FIG. 26) and showing initial movement of the picking-hand bracket as the power lift mechanism moves toward a lifting phase where the picking-hand bracket moves vertically.

Figure 28:
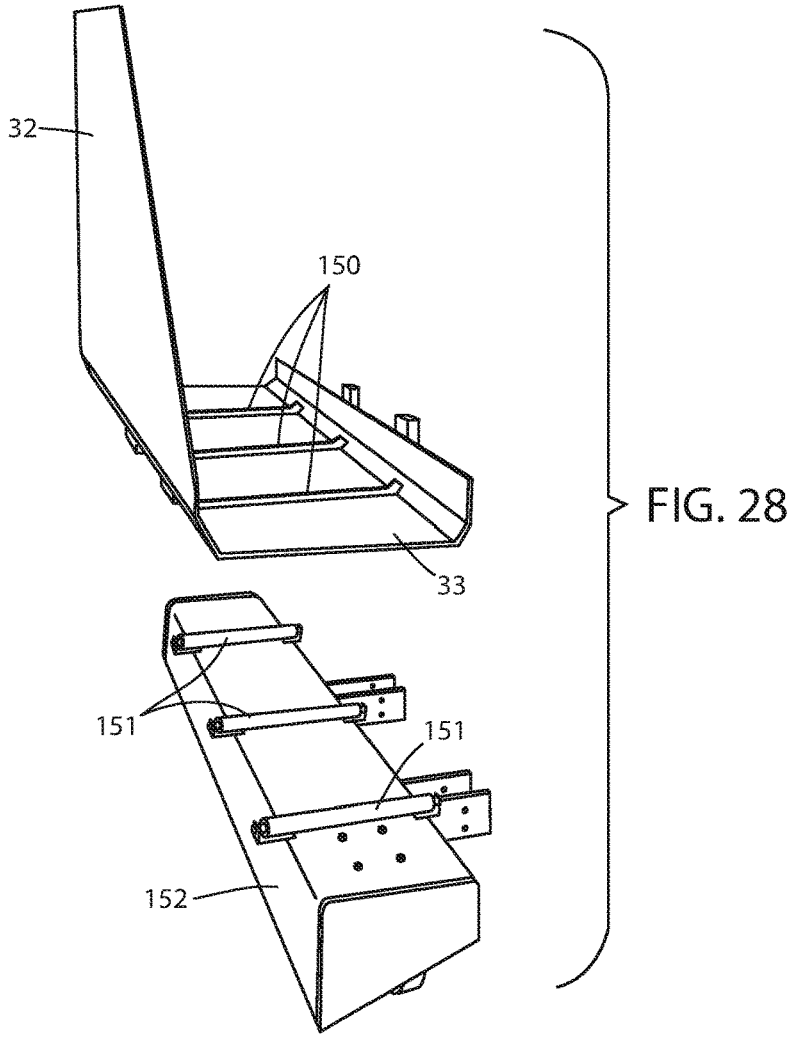
FIG. 28 is a perspective view of the storage unit (i.e. storage section and chute section) and a ground-engaging support beam, the ground-engaging support beam including cylinder rollers (three shown) that are below a surface of the storage section until engagement with the ground causes the cylinder rollers to protrude into the storage section, at which time the cylinder rollers assist in rolling (heavy) elongated picked product laterally out an end of the storage section.
Figure 29:
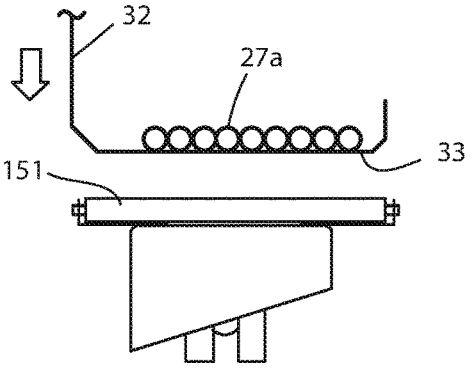
FIGS. 29 and 30 are side views of FIG. 28, FIG. 29 showing the cylinder rollers below the storage section (i.e. before ground engagement) and FIG. 30 showing the cylinder rollers protruding into the storage section (i.e. after beam-to-ground engagement).
Figure 30:
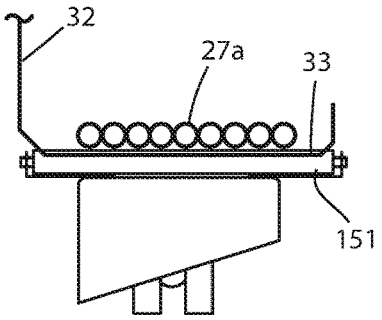

FIG. 28 is a perspective view of the storage unit (i.e. storage section and chute section) and a ground-engaging support beam, the ground-engaging support beam including cylinder rollers that are below a surface of the storage section until engagement with the ground causes the cylinder rollers to protrude into the storage section, at which time the cylinder rollers assist in rolling (heavy) elongated picked product laterally out an end of the storage section. FIGS. 29 and 30 are side views of FIG. 28, FIG. 29 showing the cylinder rollers below the storage section (i.e. before ground engagement) and FIG. 30 showing the cylinder rollers protruding into the storage section (i.e. after beam-to-ground engagement).

The present innovation includes a method of handling elongated product stored on storage racks. The method includes steps of providing a wheeled lift truck with a powered lift tower with an operator stand-on platform and lift controls; the truck including an elongated picked-product storage unit including an under-platform storage section located generally below the platform, the storage section being configured to receive picked product from a vertical direction that is dropped by an operator and store the picked product in a weight-balanced position that is at least partially under the platform. The method further includes raising the stand-on platform and under-platform storage section from ground level to a raised position; picking selected elongated product from a storage rack; lowering the picked product vertically to a location below the storage section while still in the raised position; lowering the stand-on platform and picked product to ground level; and removing the picked product from the storage section.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A side picker apparatus for handling elongated product stored on storage racks, comprising:

a wheeled lift truck with a powered lift tower with an operator stand-on platform and lift controls; and a picked-product storage unit including an under-platform storage section located generally below the platform, the storage section being configured to receive picked elongated product as the picked elongated product is lowered to a storage position in a weight-balanced position that is at least partially under the platform, wherein the picked-product storage unit includes a chute section defining a path for directing picked elongated product from a raised position adjacent the platform to the storage position within the under-platform storage section.

2. The apparatus of claim 1, wherein the chute section and storage section define an L-shape that extends vertically adjacent the platform and under the platform, with the chute section being spaced slightly from the platform to provide vertical access to the storage position under the platform for the picked elongated product.

3. The apparatus of claim 1, including a picked-product handling device on the powered lift tower, the picked-product handling device including at least one lowering device for controlled lowering of the picked elongated product from above the platform to the storage section.

4. The apparatus of claim 3, wherein the picked-product handling device includes a power mechanism for powered movement of the at least one lowering device.

5. The apparatus of claim 3, wherein the at least one lowering device includes at least one picking-hand bracket and a lift guide for guiding movement of the at least one picking-hand bracket, so that the picked product can be carefully lowered at a safe and non-damaging rate from above the platform to the storage section below the platform.

6. The apparatus of claim 5, wherein the at least one picking-hand bracket includes a first portion adapted to carry the picked product as the picked product is lowered vertically, and further includes a second portion adapted to both keep the picked product on the first portion during vertical movement and also bias the picked product horizontally as the picked product laterally enters the storage section.

7. The apparatus of claim 3, wherein the at least one lowering device of the picked-product handling device includes at least two horizontally-spaced-apart lowering devices.

8. The apparatus of claim 3, wherein the at least one lowering device of the picked-product handling device includes at least two vertically-spaced-apart lowering devices, with the vertically-spaced-apart lowering devices being configured to lift as well as lower picked product, thus facilitating restocking "new" product onto the storage racks by providing multiple locations for carrying the "new" product to be restocked onto racks.

9. An improvement in a side picker apparatus that includes a wheeled lift truck with a motor, a power supply, a motor-driven drive for moving the lift truck along an aisle, and a powered lift tower configured to lift an operator platform and lift controls; the improvement comprising:

an elongated picked-product storage unit including an under-platform storage section constructed for attachment under and generally below the platform but having a storage space accessible from above and that is configured to receive and store the picked product in a weight-balanced position, the storage section including a chute-forming side facing away from the lift tower and having open ends that open laterally outwardly from the chute-forming side, the chute-forming side providing a path for picked product to enter the storage section, and the open ends providing a space for outwardly-extending ends of the picked product to extend beyond edges of the platform.

10. A side picker apparatus comprising:

a wheeled lift truck with a motor, a power supply, a motor-driven drive for moving the lift truck along an aisle, and a powered lift tower configured to lift an operator platform and lift controls; and an elongated picked-product storage unit including a chute section constructed to guide picked product toward an under-platform storage section located generally under the platform and being configured to receive and store the picked product in a weight-balanced position, the chute section and storage section defining an L-shape that extends above and below the platform.

11. The apparatus of claim 10, wherein the storage section extends both under and below the platform.

12. A method of handling elongated product stored on storage racks, comprising steps of:

providing a wheeled lift truck with a powered lift tower with an operator stand-on platform and lift controls; the truck including an elongated picked-product storage unit including an under-platform storage section located generally below the platform, the storage section being configured to receive picked product from a vertical direction that is dropped by an operator and store the picked product in a weight-balanced position that is at least partially under the platform;

raising the stand-on platform and under-platform storage section from ground level to a raised position;

picking selected elongated product from a storage rack;

lowering the picked product vertically to a location below the storage section while still in the raised position;

lowering the stand-on platform and picked product to ground level; and removing the picked product from the storage section.

* * * * *